US008172427B2

(12) United States Patent
Hsu

(10) Patent No.: US 8,172,427 B2
(45) Date of Patent: May 8, 2012

(54) LED DECORATIVE LAMP

(76) Inventor: Fu-Hsien Hsu, Hsinchu (TW)

( * ) Notice: Subject to any disclaimer, the term of this patent is extended or adjusted under 35 U.S.C. 154(b) by 251 days.

(21) Appl. No.: 12/625,556

(22) Filed: Nov. 25, 2009

(65) Prior Publication Data

US 2011/0122613 A1 May 26, 2011

(51) Int. Cl.
*F21S 4/00* (2006.01)

(52) U.S. Cl. ..... 362/249.16; 362/231; 362/654; 313/318.01; 439/699.2

(58) Field of Classification Search ..... 362/652, 362/653, 654, 644, 249.16, 231; 313/318.06, 313/317, 318.01, 318.12; 439/699.1, 699.2
See application file for complete search history.

(56) References Cited

U.S. PATENT DOCUMENTS

| | | | | |
|---|---|---|---|---|
| 3,596,136 | A * | 7/1971 | Fischer | 257/794 |
| 4,573,754 | A * | 3/1986 | Hill | 439/280 |
| 5,239,226 | A * | 8/1993 | Seredich et al. | 313/318.01 |
| 5,672,000 | A * | 9/1997 | Lin | 362/249.06 |
| 5,951,152 | A * | 9/1999 | Zabawski et al. | 362/368 |
| 6,471,021 | B1 * | 10/2002 | Sasse et al. | 192/3.29 |
| 6,776,496 | B2 * | 8/2004 | Cok | 362/84 |
| 6,787,990 | B2 * | 9/2004 | Cok | 313/504 |
| 2004/0042199 | A1 * | 3/2004 | Cok | 362/84 |

* cited by examiner

*Primary Examiner* — John A Ward
(74) *Attorney, Agent, or Firm* — Leong C. Lei

(57) ABSTRACT

The LED decorative lamp contains a three-terminal LED device, a flexible core for the plugging of the three-terminal LED device, and a seat for the configuration of the flexible core. The seat contains three terminal plates for the electrical contact with the three terminals of the LED device. A lamp string formed by connecting multiple such LED decorative lamps enjoys accurate flash timing, thereby achieving appealing lighting effect.

3 Claims, 7 Drawing Sheets

LED DECORATIVE LAMP

(a) TECHNICAL FIELD OF THE INVENTION

The present invention generally relates to LED decorative lamps, and more particularly to an LED decorative lamp using three-terminal LED devices and a local passive IC to achieve accurate flash timing when multiple LED decorative lamps are connected into a lengthy lamp string.

(b) DESCRIPTION OF THE PRIOR ART

The LED decorative lamp of the present invention refers to one that could be connected into a lamp string for the decoration of; for example, Christmas trees. As shown in FIG. 1, a conventional LED decorative lamp 1 contains an LED device 10, a flexible core 20, and a seat 30. Usually, the LED device 10 has two terminals 11 and 12 that are plugged into the flexible core 20. On the other hand, two terminal plates 41 and 42 are configured in the seat 30 that are connected to the two wires of a power cable 40, respectively. When the flexible core 20 is positioned in the seat 30, the LED device 10's two terminals 11 and 12 are directly in contact with the terminal plates 41 and 42, respectively, to form electrical connection. As such, multiple LED decorative lamps 1 could be connected by the cable 40 into a lamp string.

FIG. 2 is schematic circuit diagram showing such a lamp string. The lamp string contains a controller 60 to control the LED decorative lamps 1's flash pattern. The controller 60 contains an active IC and connects the LED decorative lamps 1 in parallel via a positive wire and a negative wire. When the lamp string is turned on, the controller 60's IC flashes each LED decorative lamp. As the lamp string usually contains tens or hundreds of LED decorative lamps 1, some of their flash timing is not quite accurate as only a single IC in the controller 60 is responsible for the control, thereby affecting the overall lighting effect.

SUMMARY OF THE INVENTION

A main objective of the present invention is to provide a novel LED decorative lamp which contains a three-terminal LED device, a flexible core for the plugging of the three-terminal LED device, and a seat for the configuration of the flexible core. The seat contains three terminal plates for the electrical contact with the three terminals of the LED device. A lamp string formed by connecting multiple such LED decorative lamps enjoys accurate flash timing, thereby achieving appealing lighting effect.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
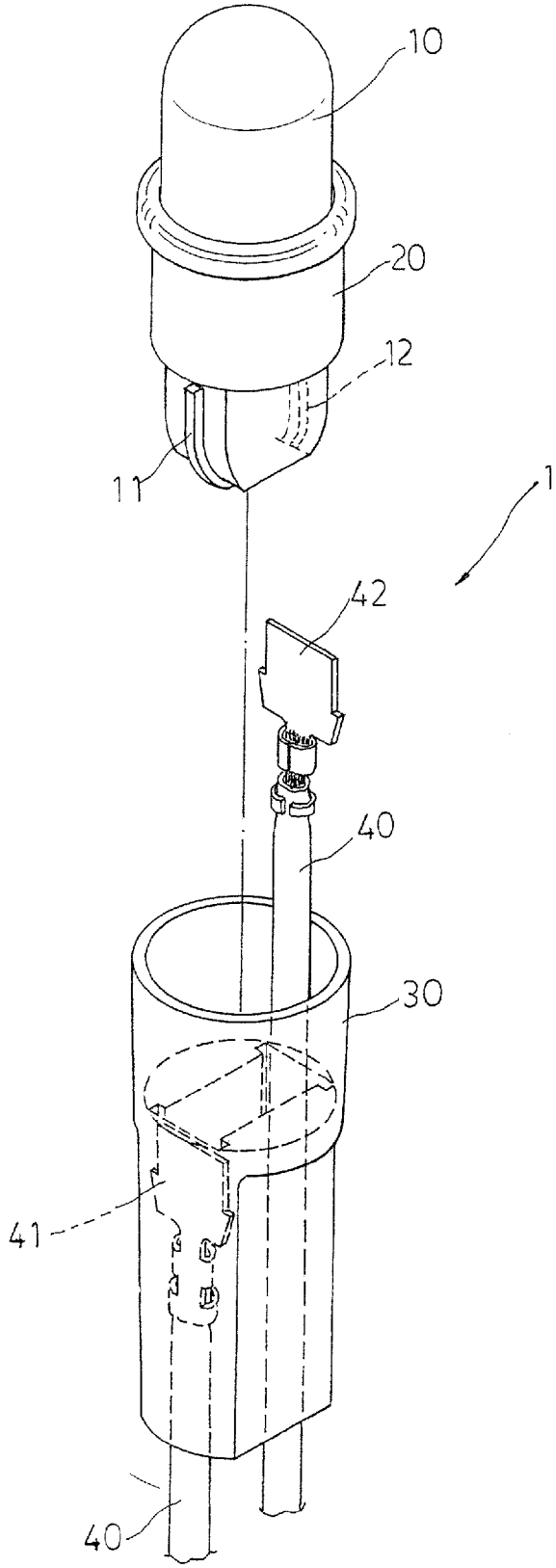
FIG.1 PRIOR ART
FIG. 1 is a perspective break-down diagram of a conventional LED decorative lamp.
Figure 2:
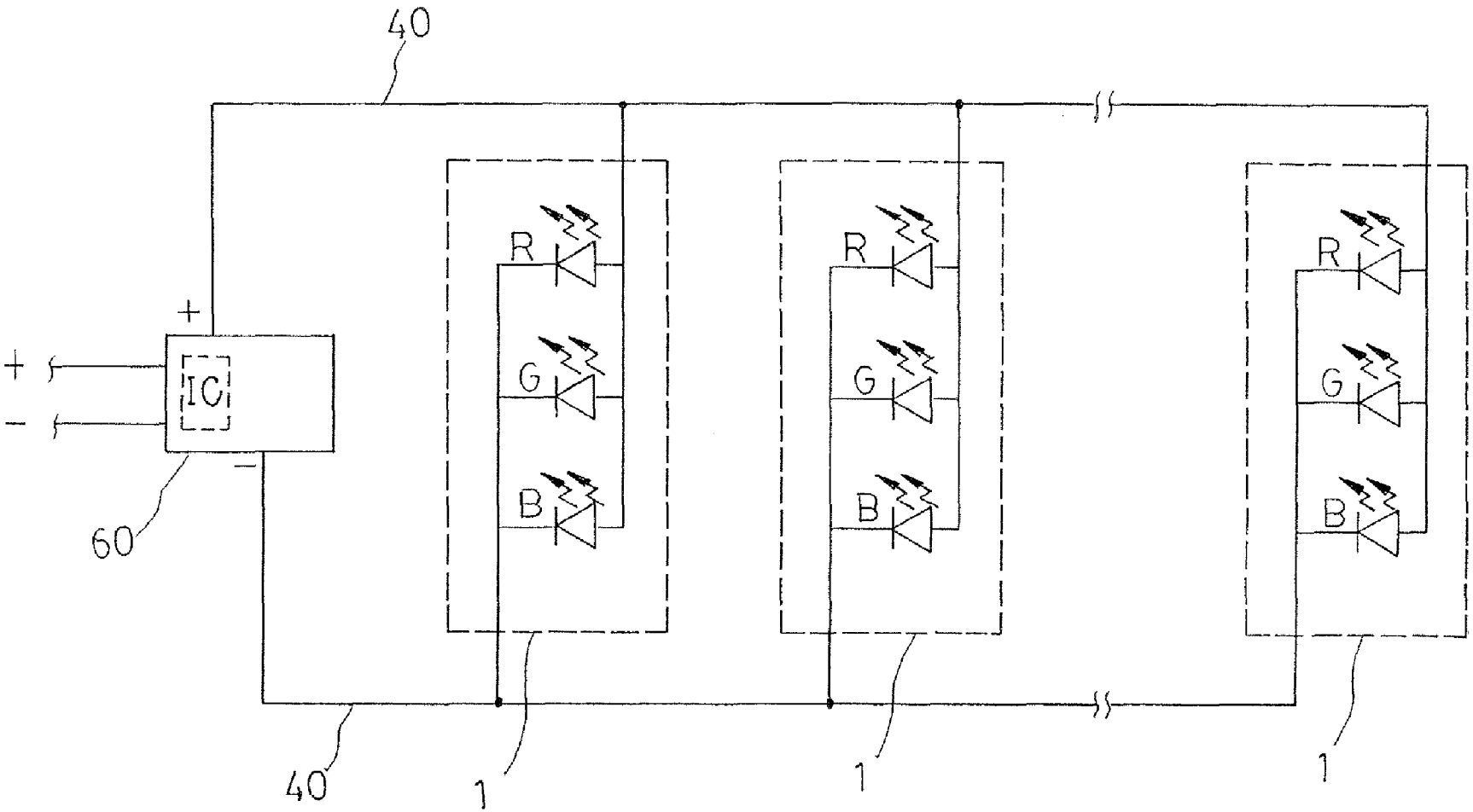
FIG.2 PRIOR ART
FIG. 2 is a schematic circuit diagram of a lamp string connecting multiple LED decorative lamps of FIG. 1.
Figure 3:
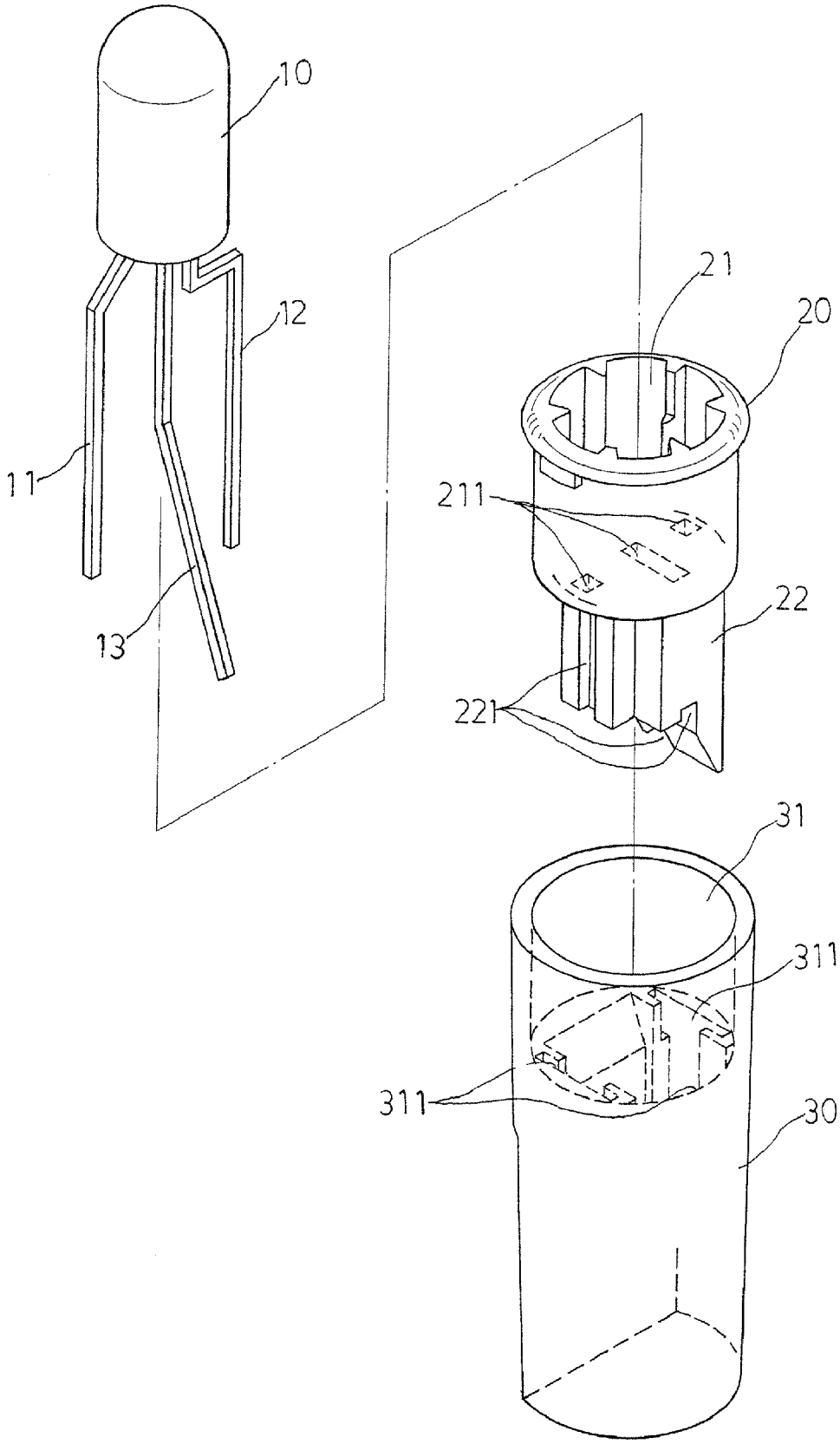
FIG. 3 is a perspective break-down diagram of an LED decorative lamp according to an embodiment of the present invention.
Figure 4:
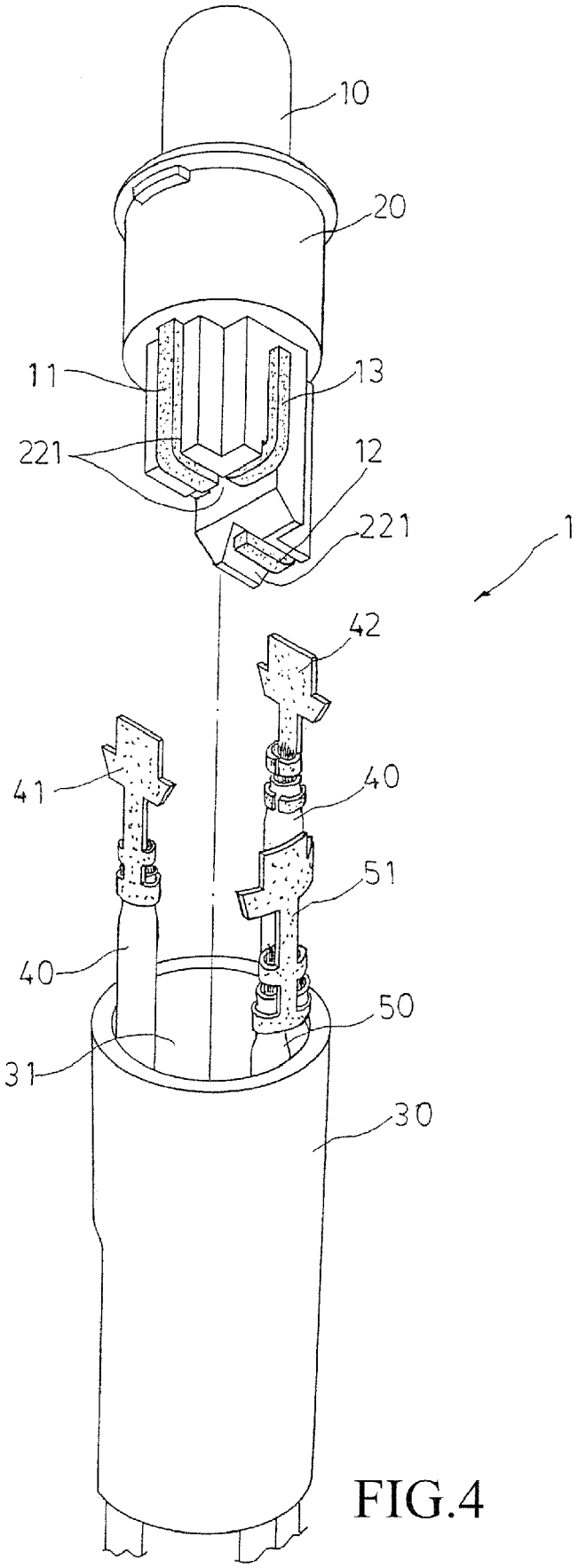
FIG. 4 is a perspective break-down diagram of the LED decorative lamp of FIG. 3 from a different viewing angle.
Figure 5:
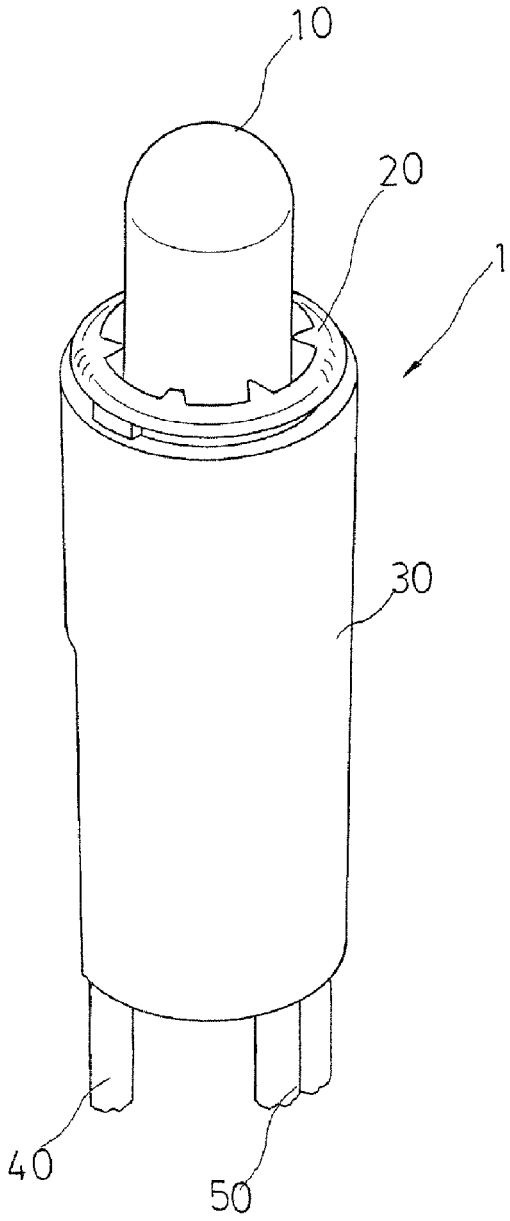
FIG. 5 is a perspective diagram showing the LED decorative lamp of FIG. 3 after its assembly.
Figure 6:
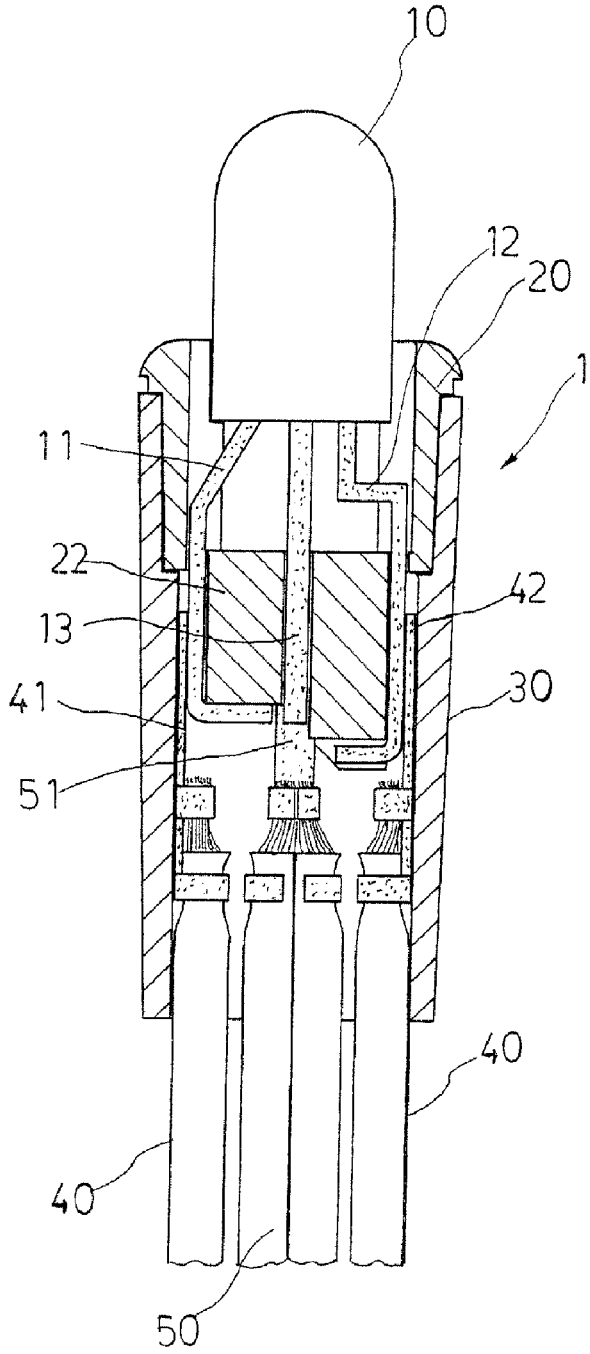
FIG. 6 is a schematic diagram showing the interior of the LED decorative lamp of FIG. 3.

As shown in FIGS. 3 and 4, a LED decorative lamp according to an embodiment of the present invention contains an LED device 10, a flexible core 20, and a seat 30. The LED device 10 has three terminals 11, 12, 13 extended from a bottom side of the LED device 10. The flexible core 20 contains a hollow socket member 21 and a support member 22 beneath the socket member 21. The support member 22 has three vertical grooves 221 conducting to the socket member 21 via three openings 211 on a bottom side of the socket member 21. The seat 30 has a tubular shape 30. An accommodation chamber 31 is provided in an upper section of the seat 30, and three slots 311 are provided in a lower section of the seat 30. When the LED device 10 is positioned in the socket member 21 of the flexible core 20, its three terminals 11, 12, 13 are threaded through the openings 211 into the three vertical grooves 221. The three terminals 11, 12, 13 are then bended so that their tips laterally attached to a bottom side of the support member 22. As such, the LED device 10 is reliably joined to the flexible core 20. Positive and negative power wires 40 and a signal wire 50 are threaded through the seat 30 into the accommodation chamber 31. The wires 40 and 50 have terminal plates 41, 42, and 51 attached to their ends, which are securely positioned in the slots 311, respectively. As further shown in FIGS. 5 and 6, the flexible core 20 with the LED device 10 plugged in is positioned in the accommodation chamber 31 of the seat 30 so that the terminals 11, 12 are in contact with the terminal plates 41, 42, and the terminal 13 in the middle is in contact with the terminal plate 51.

Figure 7:
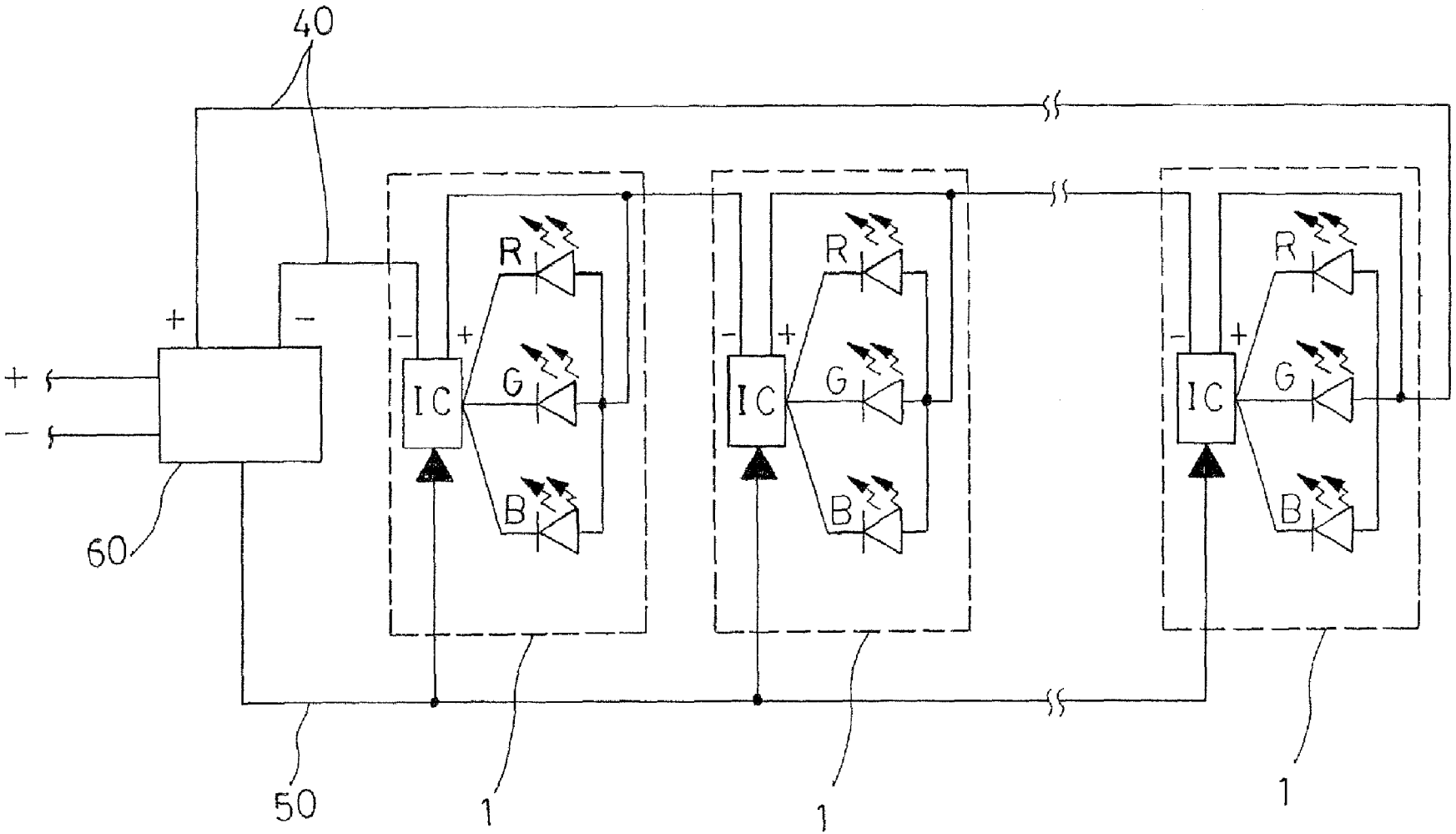
FIG. 7 is schematic circuit diagram showing a lamp string connecting multiple LED decorative lamps of FIG. 3 in series.
Figure 8:
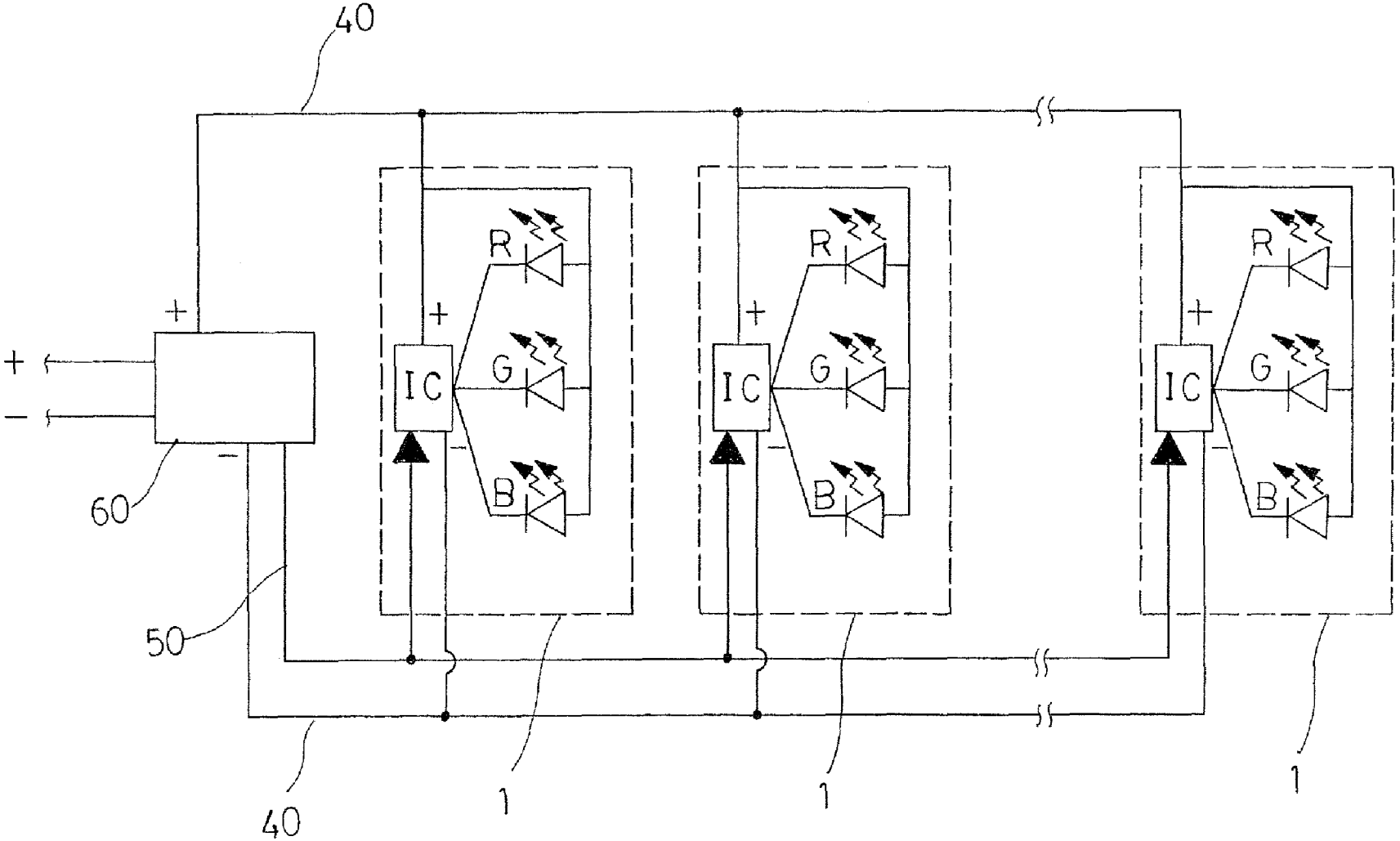
FIG. 8 is schematic circuit diagram showing a lamp string connecting multiple LED decorative lamps of FIG. 3 in parallel.

FIGS. 7 and 8 show how a lamp string is formed by connecting multiple LED decorative lamps 1 in series and in parallel. Each lamp string has a controller 60 to control the LED decorative lamps 1 as in the prior art. Each LED device in the LED decorative lamps 1 contains three dies for emitting red (R), green (G), and blue (B) lights, respectively. The three dies are connected to a passive IC inside each LED decorative lamp 1. The controller 60 is connected to each passive IC via the positive and negative power wires 40 and the signal wire 50. As such, the controller 60 is able to configure each passive IC and, when the lamp string is turned on, each LED device is directly controlled by its local passive IC. Therefore, no matter how many LED decorative lamps 1 are connected and even there is only a single controller 60, the flash timing of each LED decorative lamp 1 is accurately and precisely controlled by the passive IC. The lengthy lamp string would not suffer any timing error due to signal delay.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. An LED decorative lamp comprising:

a flexible core;

an LED device plugging into said flexible core and having three terminals; and a seat having three terminal plates configured at the ends of two power wires and a signal wire, respectively;

wherein said flexible core contains a hollow socket member for receiving said LED device and a support member beneath said socket member; said socket member has three openings along a bottom side thereof; said support member has three grooves to receive said terminals of said LED device after said terminals are threaded through said openings, respectively;

when said flexible core along with said LED device plugged in is positioned in said seat, a first one and a second one of said terminals are attached to a first one and a second one of said terminal plates of said power wires, and a third one of said terminals in a middle is attached to a third one of said terminal plates of said signal wire.

2. The LED decorative lamp according to claim 1, wherein said seat has a tubular shape; an accommodation chamber is provided in an upper section for receiving said flexible core; and three slots are provided in a lower section for positioning said terminal plates.

3. The LED decorative lamp according to claim 1, wherein multiple said LED decorative lamp are connected into a lamp string; said lamp string further contains a controller; each LED device of said LED decorative lamps contains three dies emitting different colors, and a passive IC connecting said dies; and said controller is connected to each of said passive ICs via positive and negative power wires and a signal wire.

* * * * *